US007475700B2

(12) United States Patent
Pollard

(10) Patent No.: US 7,475,700 B2
(45) Date of Patent: Jan. 13, 2009

(54) PORTABLE SHELTER

(76) Inventor: Ricky R. Pollard, Box 51, Stratton, Ontario (CA) P0W 1N0

( * ) Notice: Subject to any disclaimer, the term of this patent is extended or adjusted under 35 U.S.C. 154(b) by 61 days.

(21) Appl. No.: 11/530,056

(22) Filed: Sep. 8, 2006

(65) Prior Publication Data

US 2007/0056619 A1 Mar. 15, 2007

(30) Foreign Application Priority Data

Sep. 8, 2005 (CA) ..... 2518570

(51) Int. Cl.
*E04H 15/00* (2006.01)

(52) U.S. Cl. ..... 135/132; 135/138; 135/148

(58) Field of Classification Search ..... 135/133, 135/132, 138, 148, 137, 906; 114/361; 296/136.12
See application file for complete search history.

(56) References Cited

U.S. PATENT DOCUMENTS

| | | | | | |
|---|---|---|---|---|---|
| 2,798,501 | A * | 7/1957 | Oliver | 135/134 |
| 3,712,316 | A * | 1/1973 | Leonard | 135/88.16 |
| 3,906,968 | A * | 9/1975 | Black | 135/132 |
| 4,116,206 | A | 9/1978 | Warner et al. | |
| 4,244,384 | A * | 1/1981 | Bean | 135/132 |
| 4,271,856 | A * | 6/1981 | Ferguson | 135/132 |
| 4,425,929 | A | 1/1984 | Van Mosshaim | |
| 4,886,083 | A * | 12/1989 | Gamache | 135/88.06 |
| 5,004,001 | A * | 4/1991 | Bouchard | 135/97 |
| 5,159,947 | A * | 11/1992 | Chuang et al. | 135/132 |
| 5,539,957 | A * | 7/1996 | Schmidt | 16/331 |
| 5,655,559 | A * | 8/1997 | Zembik et al. | 135/132 |
| 5,740,826 | A * | 4/1998 | Nevin et al. | 135/88.06 |
| 5,746,237 | A | 5/1998 | Arnic | |
| 5,842,495 | A | 12/1998 | Egnew et al. | |
| 6,267,130 | B1 * | 7/2001 | Konda | 135/133 |
| 6,349,732 | B1 | 2/2002 | Cooper | |
| 6,371,873 | B1 * | 4/2002 | Wang | 473/478 |
| 7,013,904 | B2 * | 3/2006 | Kofler | 135/132 |
| 7,051,481 | B2 * | 5/2006 | Delavega et al. | 52/66 |
| 7,140,377 | B1 * | 11/2006 | Dahulich | 135/136 |
| 2006/0054208 | A1 * | 3/2006 | Romano | 135/132 |
| 2006/0162758 | A1 * | 7/2006 | Painchaud | 135/133 |
| 2007/0295380 | A1 * | 12/2007 | Glaeser | 135/133 |

* cited by examiner

*Primary Examiner*—David R Dunn
*Assistant Examiner*—James Alex
(74) *Attorney, Agent, or Firm*—Ade & Company Inc; Ryan W. Dupuis; Kyle R. Satlerthwaite

(57) ABSTRACT

A portable shelter comprises a pair of base members pivotally supporting a plurality of support arches spanning therebetween. Each support arch is hinged at an apex thereof to permit folding of the arch support in half for storage. The support arches are coupled to the base members for pivotal movement about respective pivot axes in which ends portions of the support arches are offset both axially and radially relative to the respective pivot axes from the other support arches to permit the support arches to be nested within one another flat against the ground prior to folding to enhance the compactness of the shelter in storage.

19 Claims, 9 Drawing Sheets

PORTABLE SHELTER

FIELD OF THE INVENTION

The present invention relates to a portable shelter of the type comprising a plurality of support arches which are pivotal from a collapsed position into domed structure supporting a cover spanning the support arches.

BACKGROUND

Various types of portable shelters are known in which the shelter is permitted to be collapsed for storage when not in use. Examples of portable shelters include U.S. Pat. No. 6,349,732 to Cooper, U.S. Pat. No. 4,116,206 to Warner et al., U.S. Pat. No. 5,746,237 to Arnic and U.S. Pat. No. 4,425,929 to Von Mosshaim. In each instance the shelter generally comprises a plurality of support arches which are pivotally coupled at opposing free ends thereof for relative pivotal movement between a collapsed position in which the support arches are all positioned adjacent one another and a domed structure in which the support arches are angularly offset from one another to form a dome structure with a suitable cover spanning the arches. Typical prior art shelters have limited collapsibility as the arches, even when positioned adjacent one another, are still sufficiently larger to fully span the width of the assembled shelter that the collapsed shelter remains cumbersome for storage.

U.S. Pat. No. 5,842,495 to Egnew et al. discloses a shelter including a plurality of support arches pivotal relative one another in which each arch is hinged at an apex thereof to permit the arches to be folded in half to further collapse the shelter for storage. The support arches are pivotally supported on respective base members in a manner so that when the support arches are pivoted against one another for collapsing, the apexes of the arches lie in a common plane which is perpendicular to the desired direction of folding. Awkward manipulation of the hinges is thus required as the outermost support arch when folding at the apex must stretch across the combined width of all of the arches stacked against one another. In addition to the awkward manipulation of the hinges, the stacked arrangement of the apexes still has considerable bulk.

SUMMARY OF THE INVENTION

According to one aspect of the invention there is provided a portable shelter comprising:

a plurality of support arches, each arch comprising first and second end portions and first and second arched segments continuous with the first and second end portions respectively, the first and second arched segments being pivotally coupled to one another at an apex of the arch such that the end portions are foldable against one another;

a first base member pivotally coupling each first end portion thereon for pivotal movement about a respective pivot axis so as to be offset in a radial direction and in an axial direction in relation to the respective pivot axis from the first end portions of the other arched segments;

a second base member pivotally coupling each second end portion thereon for pivotal movement about a respective pivot axis so as to be offset in a radial direction and in an axial direction in relation to the respective pivot axis from the second end portions of the other arched segments; and a cover of flexible material spanning the support arches when the end portions of each arch are unfolded and spaced apart from one another and the arches are angularly offset from one another about the respective pivot axes thereof to form a domed structure enclosed by the cover.

By providing end portions of the support arches which are offset both axially and radially from one another in relation to the respective pivot axis thereof, support arches of identical configuration are permitted to be nested one within the other when laying flat in a common plane. When providing this arrangement in combination with support arches which can be folded at their respective apexes, a simplified folding configuration results as a first half of each support arch lies in a first common plane and a second half of each support arch lies in a second common plane in which the first and second common planes can be folded flat against one another in the fully collapsed storage position of the shelter in accordance with the present invention.

Alternatively, opposing end portions of the support arches may be supported within radial slots in the respective base members so that the end portions of the support arches can be stacked adjacent one another while remaining nested at the apexes in a flat plane for ease of folding. In either configuration, the hinge requirements at the apex are simplified and can be consistent with all of the support arches.

Preferably the support arches are identical in size.

Each of the first end portions may be pivotal within a plane which is parallel and spaced from the plane of the other first end portions. Likewise, each second end portion may be pivotal within a plane which is parallel and spaced from the plane of the second end portions.

The apex of each arch may comprise a link pivotally coupled to the first arched segment at a first pivot axis and pivotally coupled to the second arched segment at a second pivot axis parallel and spaced from the first pivot axis.

When each arched segment includes a pivot shaft received within the respective link at the apex which defines the pivot axis and which is oriented parallel to the respective end portion, the length of the pivot shaft is preferably equal or less than radial spacing between adjacent end portions on the base members to permit nesting of the arches within one another.

When the pivot axes of the first and second base members are spaced apart in respective longitudinal directions of the base members, each base member preferably includes extension members extending longitudinally outward from opposing ends thereof.

The extension members may be telescopic with respect to the respective base members.

There may be provided clamping members on the base member to selectively restrict relative sliding movement of the extension members.

There may be provided a pair of crossbars extending between the extension members of the opposed base members at opposite ends of the base members.

A longitudinal position of the crossbars in relation to the respective extension members is preferably adjustable.

The crossbars may be hinged centrally between the respective extension members for folding the crossbars.

There may be provided an anchor portion at the free end of each extension member which is oriented transversely to the longitudinal direction of the extensions. The anchors preferably comprise lateral projections which project laterally outward away from the arches and the opposing base member.

Each extension member may be pivotally coupled to the corresponding extension member of the opposing base member.

The cover is preferably suitably sized for covering a personal vehicle in which the crossbars are spaced apart from one another in the longitudinal direction of the base members corresponding to a wheel base of the vehicle.

The end portions of the support arches are preferably slidable in an axial direction of the respective pivot axes in relation to the respective base member.

According to a second aspect of the present invention there is provided a method of storing a portable shelter comprising:

providing a plurality of support arches, each arch comprising first and second end portions and first and second arched segments continuous with the first and second end portions respectively;

coupling the first and second arched segments pivotally to one another at an apex of the arch such that the end portions are foldable against one another;

coupling each first end portion on a first base member for pivotal movement about a respective pivot axis so as to be offset in a radial direction and in an axial direction in relation to the respective pivot axis from the first end portions of the other arched segments;

coupling each second end portion on a second base member for pivotal movement about a respective pivot axis so as to be offset in a radial direction and in an axial direction in relation to the respective pivot axis from the second end portions of the other arched segments;

providing a cover of flexible material spanning the support arches when the end portions of each arch are unfolded and spaced apart from one another and the arches are angularly offset from one another about the respective pivot axes thereof to form a domed structure enclosed by the cover;

pivoting the first and second arch segments of the support arches into a first common plane; and folding the support arches at the respective apexes thereof so as to pivot the second arch segments relative to the first arch segments about a fold axis lying parallel to the first common plane until the second arch segments lie in a second common plane parallel and adjacent to the first common plane containing the first arch segments therein.

The method may include coupling the base members with crossbars spanning between the base members at opposing ends thereof and adjusting spacing between the crossbars to correspond to a wheel base of a vehicle to be covered by the shelter.

The method may further include collapsing the base members by telescopically retracting portions of the base member.

According to a further aspect of the present invention there is provided a portable shelter comprising:

a plurality of support arches, each arch comprising first and second end portions and first and second arched segments continuous with the first and second end portions respectively, the first and second arched segments being pivotally coupled to one another at an apex of the arch such that the end portions are foldable against one another;

a first base member pivotally coupling the first end portions thereon for pivotal movement about respective pivot axes of the first end portions such that each first end portion is offset in a radial direction in relation to the respective pivot axis from the first end portions of the other arched segments;

a plurality of first slots in the first base member associated with the first end portions respectively in which each first slot extends radially in relation to the respective pivot axis and supports the respective pivot axis for radial sliding movement along the first slot, the first slots being parallel and spaced apart from one another;

a second base member pivotally coupling the second end portions thereon for pivotal movement about respective pivot axes of the second end portions such that each second end portion is offset in a radial direction in relation to the respective pivot axis from the second end portions of the other arched segments;

a plurality of second slots in the second base member associated with the second end portions respectively in which each second slot extends radially in relation to the respective pivot axis and supports the respective pivot axis for radial sliding movement along the second slot, the second slots being parallel and spaced apart from one another;

a cover of flexible material spanning the support arches when the arches are unfolded with the end portions thereof spaced apart from one another and the arches are angularly offset from one another about the respective pivot axes thereof to form a domed structure enclosed by the cover.

Various embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
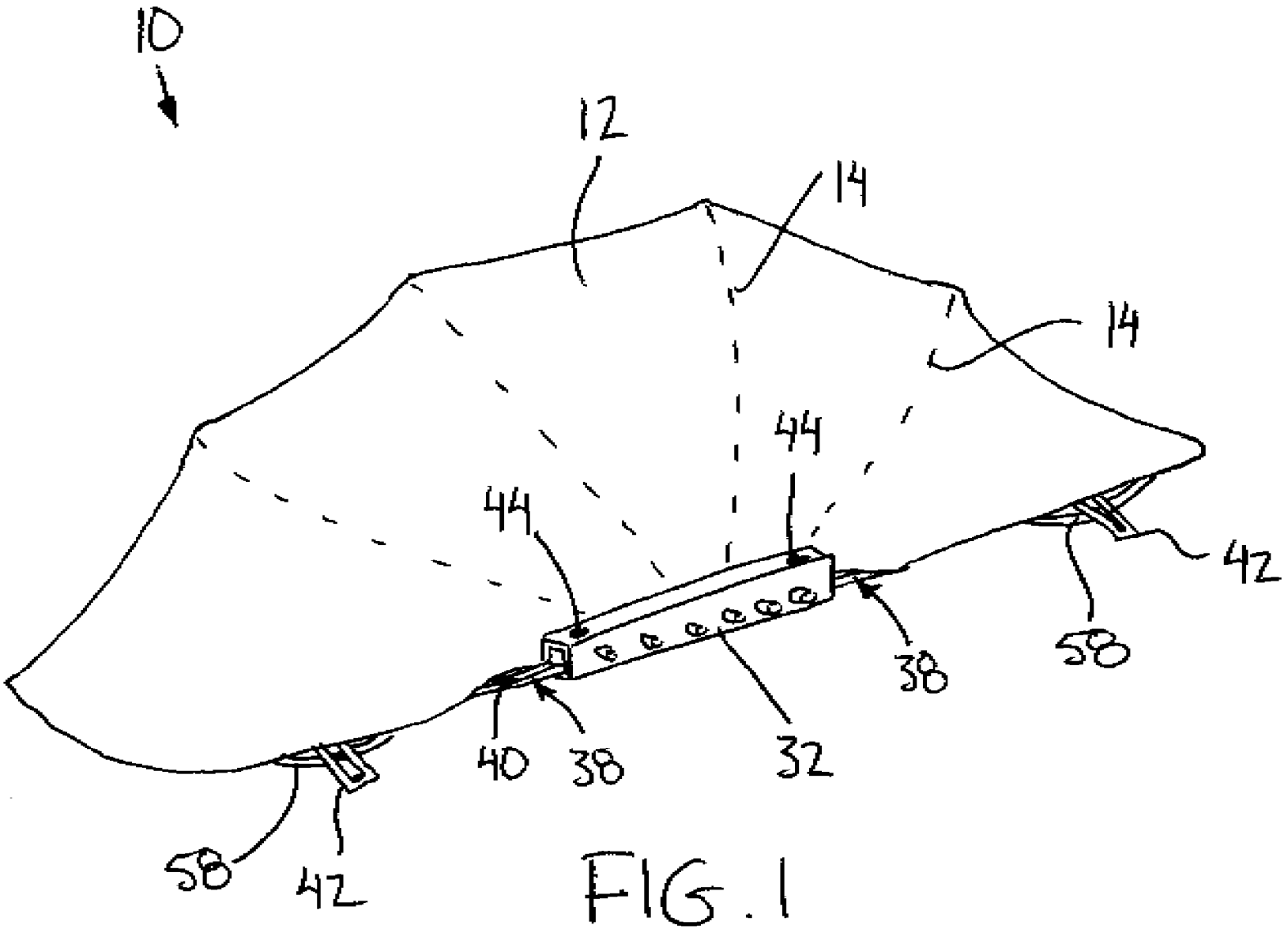
FIG. 1 is a perspective view of the shelter assembled in a dome structure.

Referring to the accompanying figures there is illustrated a shelter generally indicated by reference numeral 10. The shelter 10 includes a cover 12 which is supported by an internal frame in a domed structure of suitable size for enclosing a personal vehicle, for example a personal all terrain vehicle or a snowmobile therein. The cover 12 is suitably arranged for protecting the item stored within the shelter from the weather and surrounding elements.

The internal frame of the shelter comprises a plurality of support arches 14 configured similarly to one another and having identical dimensions. Each support arch 14 comprises first and second end portions 16 and 18 at respective free ends of the arch which are straight and formed of rod like material. A pivot shaft 20 is mounted at a bottom end of each end portion perpendicularly thereto and formed continuously therewith.

The support arches 14 further include first and second arch segments 22 and 24 formed continuously with the first and second end portions respectively so as to be integral therewith. The arched segments 22 and 24 are formed with the respective first and second end portions so as to have an obtuse interior angle while lying in a common plane with the pivot shafts 20 at the opposing ends of the end portions. The arched segments and the end portions extend in opposite radial directions from the longitudinal direction of the end portions.

The first and second arch segments of each support arch meet at the apex 26 of the arch where they are pivotally coupled by a suitable link 30. The inner end of each arched segment is formed into a pivot shaft 28 oriented generally parallel to the respective end portion. The link 30 couples the pivot shaft 28 of the first and second arched segments so that the pivot shafts are parallel and spaced from one another to define a pair of parallel and spaced apart pivot axes about which the end portions are pivotal relative to one another. The length of the link 30 and accordingly the spacing between the pivot shafts 28 is arranged to be substantially equal to the thickness of the material forming the support arches so that when the support arches are folded flat against one another, the link 30 spans the combined thickness of the arched segments 22 and 24. The first and second end portions, the arched segments and the pivot shafts are all formed integrally with one another out of a stiff light weight rod material which has sufficient strength to maintain its domed structure shape while being somewhat resilient and flexible to permit some deflection under forces of the wind.

The internal frame of the shelter further comprises first and second base members 32 and 34, each comprising an elongate tubular channel of hollow square cross section which is elongate in a longitudinal direction. Each of the first and second base members mounts the pivot shafts of the respective first and second end portions respectively therein at longitudinally spaced positions so that the pivot shafts within each base member are parallel to one another and spaced apart in a radial direction of the respective pivot axes of the pivot shafts.

When the arched segments are unfolded to form the assembled shape of the support arches, the pivot shafts 20 align with the corresponding pivot shafts of the opposing end portion for pivotal movement of each support arch about a common horizontal pivot axis which is spaced in the radial direction relative to the pivot axes of all of the other support arches in a common longitudinal direction of the base members.

Each pivot shat 20 is much longer in an axial direction than the corresponding width of the base member and is mounted through apertures through opposing side walls of the base member in a manner so as to be slidable in the axial direction relative to the base member. Each end portion is thus slidable by displacing the pivot shaft between the respective end portion and a stop 36 mounted at the free end of the pivot shaft.

Each of the end portions can thus be arranged to be pivotal within a respective pivot plane which is oriented perpendicularly to the axis of the pivot shaft and which lies parallel and spaced apart from the pivot plane of any other end support supported on the same base member. This is arranged by sliding the pivot shaft 20 within the base member to arrange each end portion to be axially offset relative to its respective pivot axis in relation to any other end portion supported on the same base member. By providing both a radial and an axial offset of each pivot axis of each end portion in relation to the remaining end portions of each base member, a plurality of support arches of identical configuration can all lay flat in a common plane with the support arches nested one within the other and in a common plane with the respectively longitudinal direction of the base member. The radial distance between adjacent pivot axes in the longitudinal direction of each base member is arranged to be equal or greater than the length of the pivot shafts 28 at the apex of each support arch so as not to interfere with the nested configuration of the support arches.

Extension members 38 are included at each end of each base member for extending in the longitudinal direction of the base member outward in the direction of the pivot axis spacing beyond the pivot shafts of any of the support arches. Each extension 38 is slidably received within the respective hollow interior of the tubular channel forming the respective base member 32 or 34. The pivot shafts 20 are supported within the base member to extend horizontally thereacross somewhat centrally within the interior so as to be spaced equally from the top and bottom walls of the base member.

Each extension includes a main portion 40 extending in the longitudinal direction for being slidably received within the base member and an anchor portion 42 at the free end of the main portion 40 which extends laterally outwardly in a common plane with the main portion. The main portion comprises a pair of parallel rods which are continuous at the outer ends thereof with a U-shaped rod forming the anchor portion connected between the parallel rods of the main portion. The main portion and anchor portion of each extension 38 is thus formed as a single rod of material which has been appropriately shaped.

Thickness of the rods forming the main portion of the extensions fits within the gap between the pivot shafts and the bottom wall of the base member for being slidably received therein. A screw clamp 44 is threadably secured into the top side of the base member at each end thereof for engaging the rods of the main portion 40 to clamp the main portions against the bottom wall of the base member. The bottom free end of each screw clamp 44 is tapered for wedging between the two rods forming the main portion 40 of the extensions. Releasing the screw clamp 44 permits telescopic sliding extension of the extensions 38 outward from the respective ends of the base member until a desired position is achieved at which point the screw clamp 44 is treadably tightened to clamp the extensions in place and restrict further sliding movement thereof.

Two crossbars 46 are provided for joining the extensions 38 of the opposing base members at each of the opposing ends of the base members. Each of the two spaced apart crossbars 46 comprises two sections 48 pivotally coupled to one another at a central location. Each section 48 is generally rectangular and elongate in shape and is defined by a perimeter rod. Clamps 50 are provided at the outer ends of each crossbar 46 for clamping the perimeter rod forming the sections 48 onto the respective extensions 38. Each clamp 50 comprises a tubular channel of similar material forming the base members for similarly slidably receiving the two rods of the main portion of the extensions 38 therethrough.

Corresponding opposed apertures in opposite side walls of each clamp slidably receive the rod forming the sections 48 of the crossbar so that the rods of the crossbar overlap the rods forming the main portion of the extensions within the interior of the tubular channel forming the clamp. A threaded member 54 is threadably secured through the top side of each clamp 50 for engaging the rods of the main portion of the extension extending therethrough to selectively restrict sliding movement therebetween when it is desired to set the position of the crossbar 46 in relation to the extensions. In this configuration, the crossbars 46 can be slidably displaced along the extensions to adjust the spacing between the two crossbars as desired for alignment with the wheel base of a vehicle stored thereon within the shelter for example.

The inner ends of the two sections 48 are pivotally coupled together by links 56 which are pivotally secured to the two sections at spaced apart position thereon to define two parallel pivot axes on each link 56 about which the sections 48 are pivotal relative to one another. Spacing between the pivot axes of each link 56 corresponds approximately to the combined thickness of the material forming the crossbars 46 so that the links 56 span between the inner ends of the section 48 when the sections are folded flat against one another in the clamped position.

The cover 12 is tied to the assembled support arches 14 at a suitable spacing so that when assembled into a dome shaped structure, the support arches are angularly offset from one another at equal intervals with the cover spanning between each adjacent pair of supports arches under slight tension when the arches are unfolded so that the end portions thereof are spaced apart along with the spacing of the base members. Straps 58 are provided on the cover at spaced apart positions on opposing sides of the cover corresponding to the location of the anchor portions 42 of the extensions 38 of each base member. The straps 58 permit the cover to be secured to the anchors at the four corners of the assembled base structure of the two base members coupled together.

Figure 2:
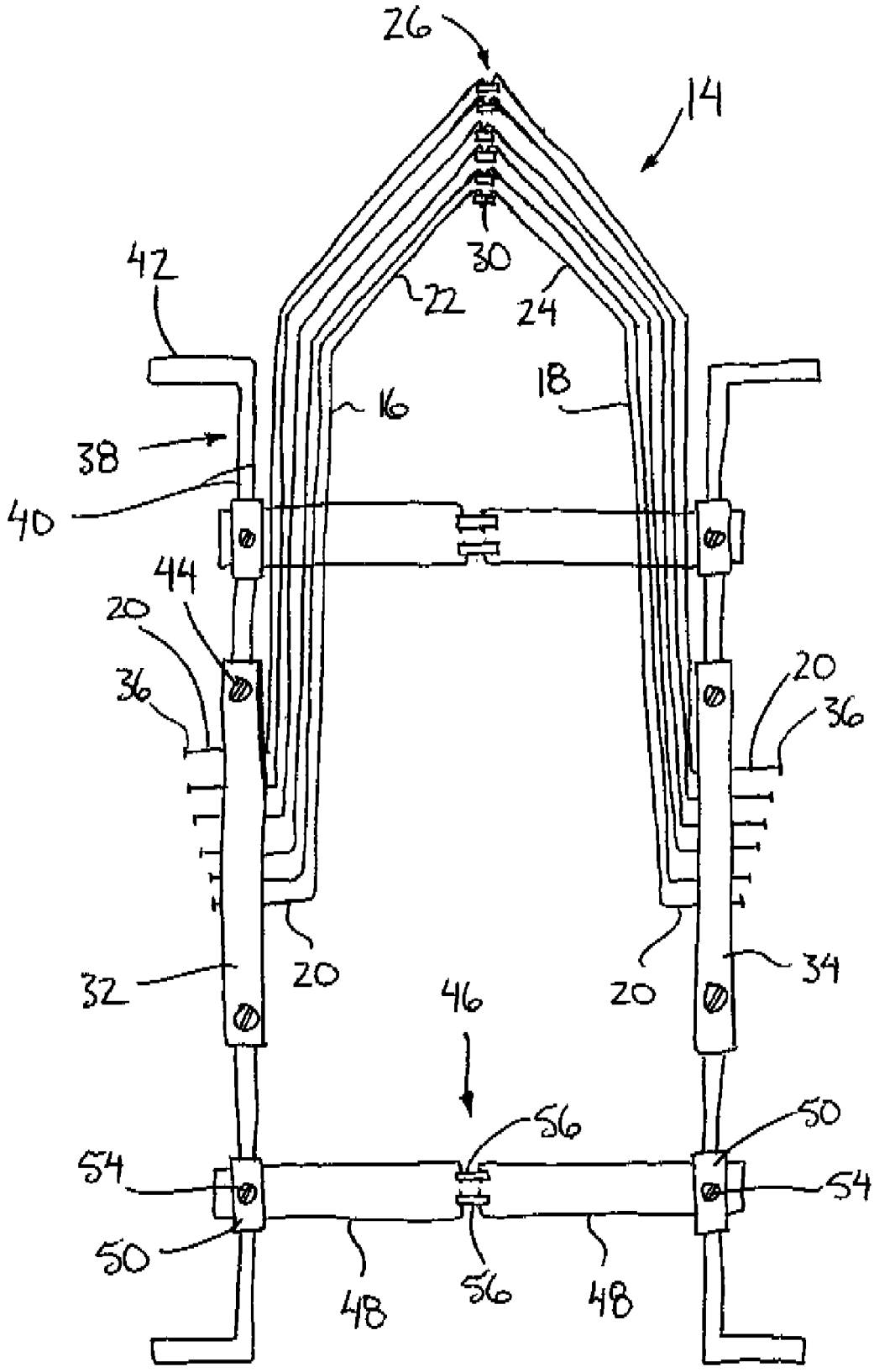
FIG. 2 is a top plan view of an internal frame of the shelter illustrating the support arches pivoted into a nested configuration prior to further collapsing by folding at the apexes thereof.
Figure 3:
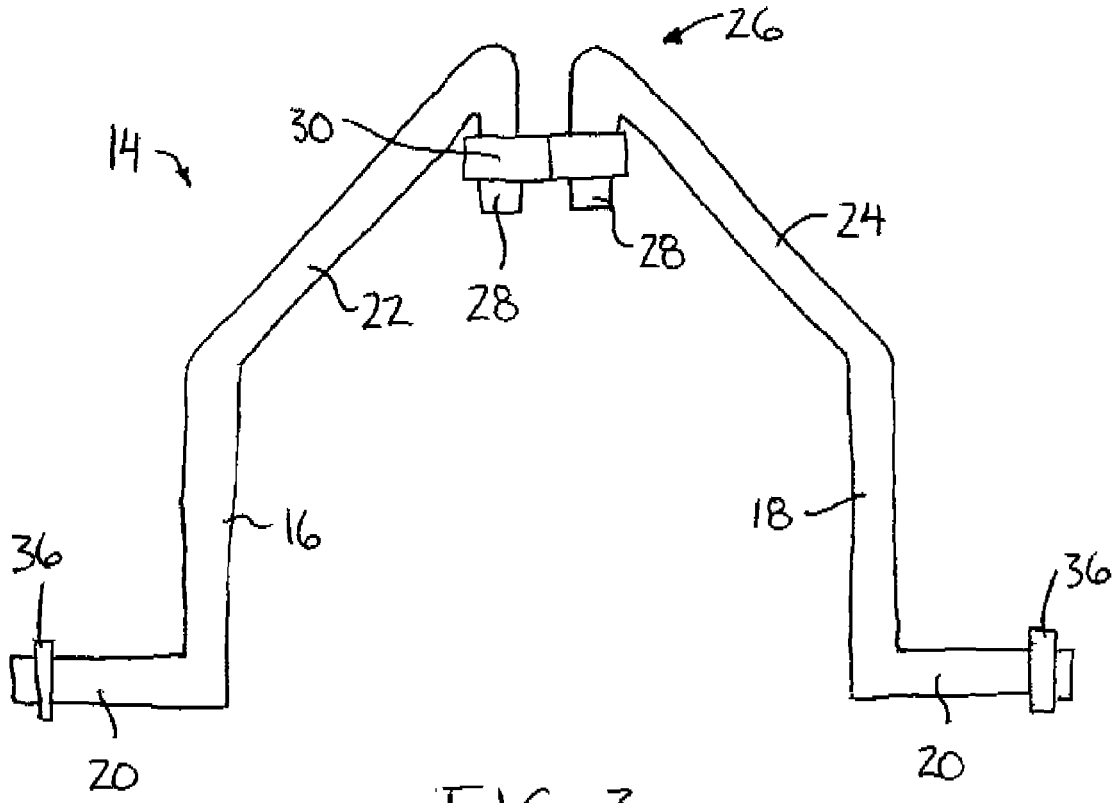
FIG. 3 is an elevational view of one of the support arches.
Figure 4:
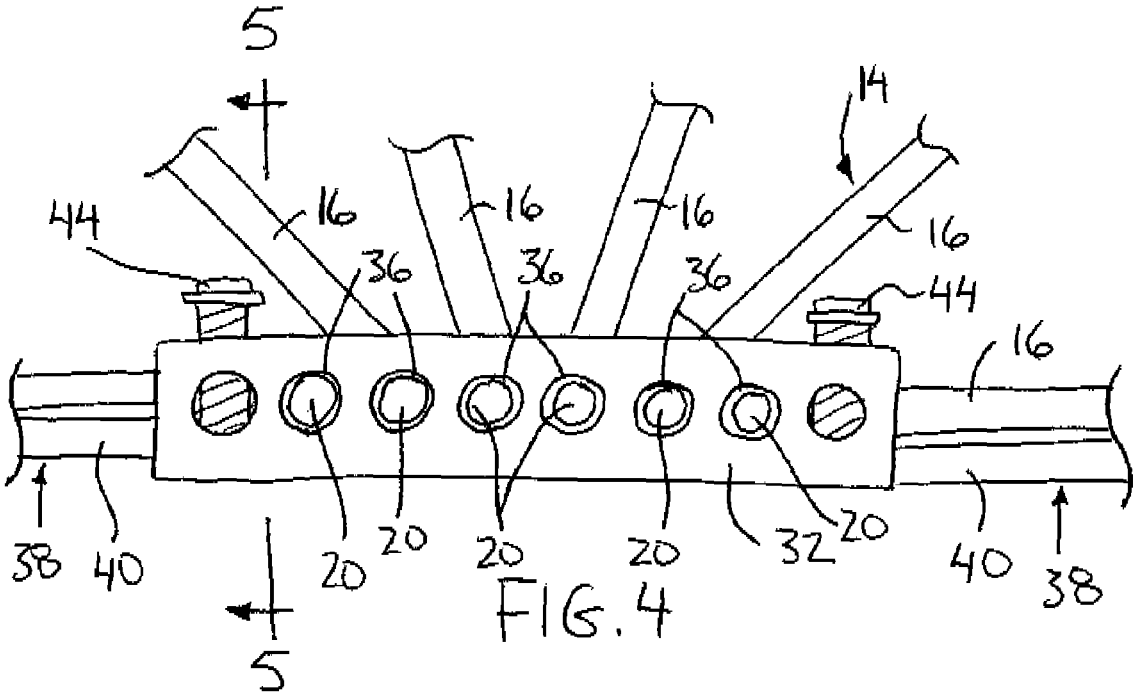
FIG. 4 is a side elevational view of one of the base members.
Figure 5:
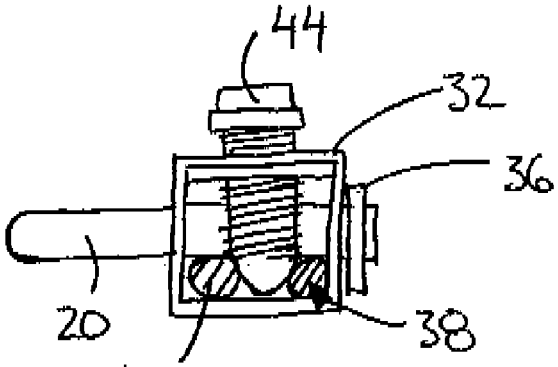
FIG. 5 is a sectional view along the line 5-5 of FIG. 4.
Figure 6:
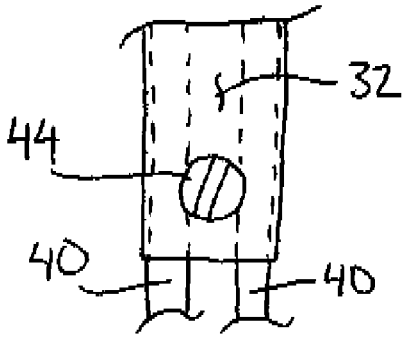
FIG. 6 is a top plan view of an end of one of the base members.
Figure 7:
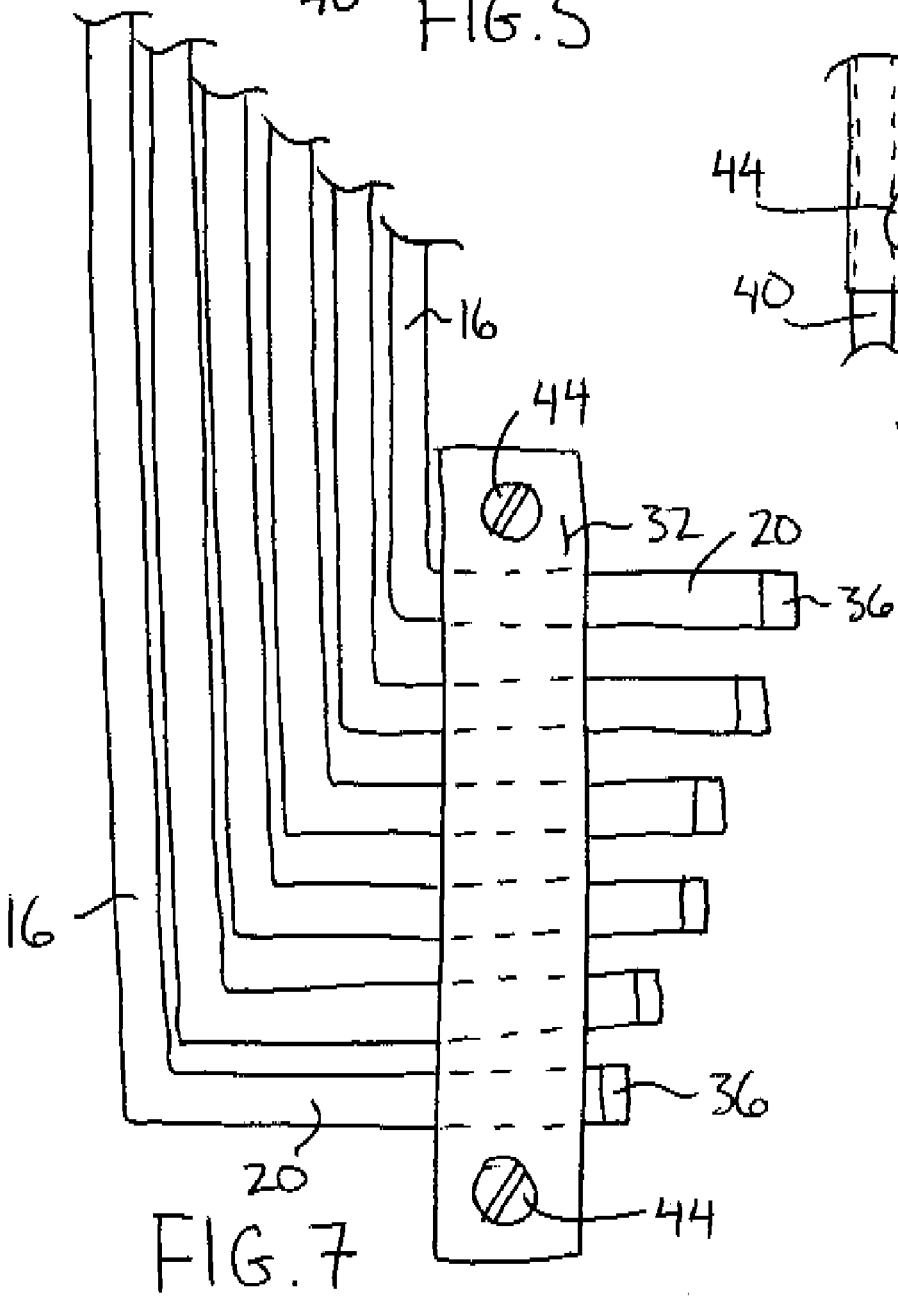
FIG. 7 is a top plan view of the base member with the support arches nested within one another.
Figure 8:
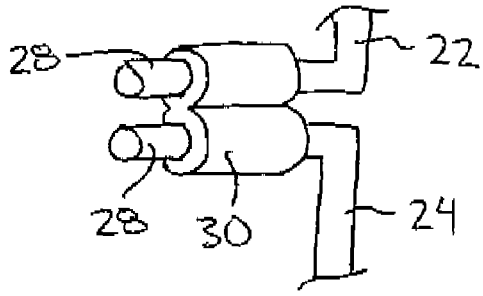
FIG. 8 is a perspective view of a link pivotally connecting the arch segments of each support arch.
Figure 9:
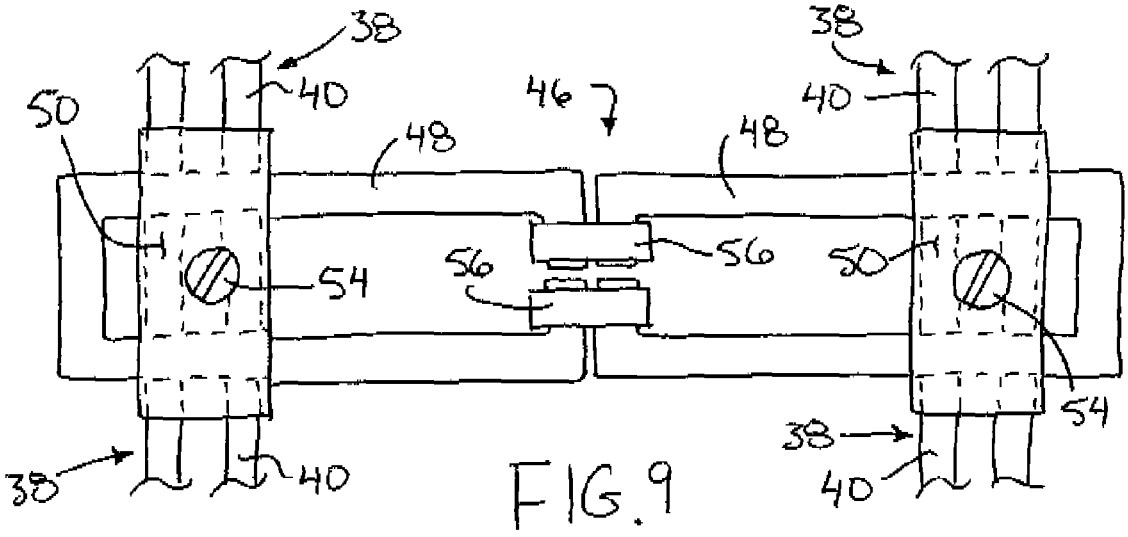
FIG. 9 is a top plan view of one of the crossbars spanning the opposed base members.
Figure 10:
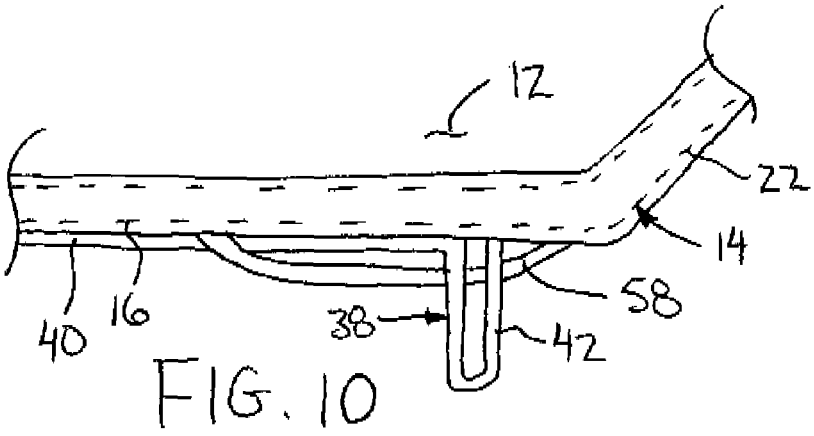
FIG. 10 is a top plan view of a portion of an outer most support arch and a portion of a surrounding cover shown anchored on one of the base members.

In use the shelter is first assembled by unfolding the crossbars 46 and simultaneously unfolding the support arches 14 at the respective apexes thereof until the base members are spaced apart corresponding to the spacing of the end portions when the support arches are unfolded to form a continuous arch. The extensions 38 are then slidably extended with the crossbars 46 being slidably positioned therealong to correspond to the spacing of a wheel base of a vehicle to be enclosed by the shelter. Position of the extensions and the crossbars are then fixed in place by the appropriate threaded clamps. The vehicle can then be parked in an overlapping arrangement with the crossbars 46 so that the base members are well secured to the ground by the weight of the vehicle. The arches can then be pivoted from a flat unfolded position as shown in FIG. 2 about the respective pivot axis until the dome structure of FIG. 1 is formed at which point the cover 12 tied to the arches is pulled along with the arches into the dome structure. The straps 58 are then secured on the respective anchors to maintain the cover and support arches in the domed structure.

For subsequent storage, the straps 58 are released from the anchors so that the support arches can again be nested one within the other by pivoting until all of the arches are flat in a common plane in which the end portions of each support arch are offset both axially and radially in relation to the respective pivot axes from the corresponding end portions of the other support arches. When all of the support arches are nested within one another and in a flat common plane with the longitudinal direction of the base members, the crossbars can be folded simultaneously with the support arches at the respective apexes thereof until the first arched segments, the first end portions and the first base member all lie in a first common plane and the second arched segments, the second end portions and the second base member all lie in a second common plane abutted flat against and parallel to the first common plane.

Figure 11:
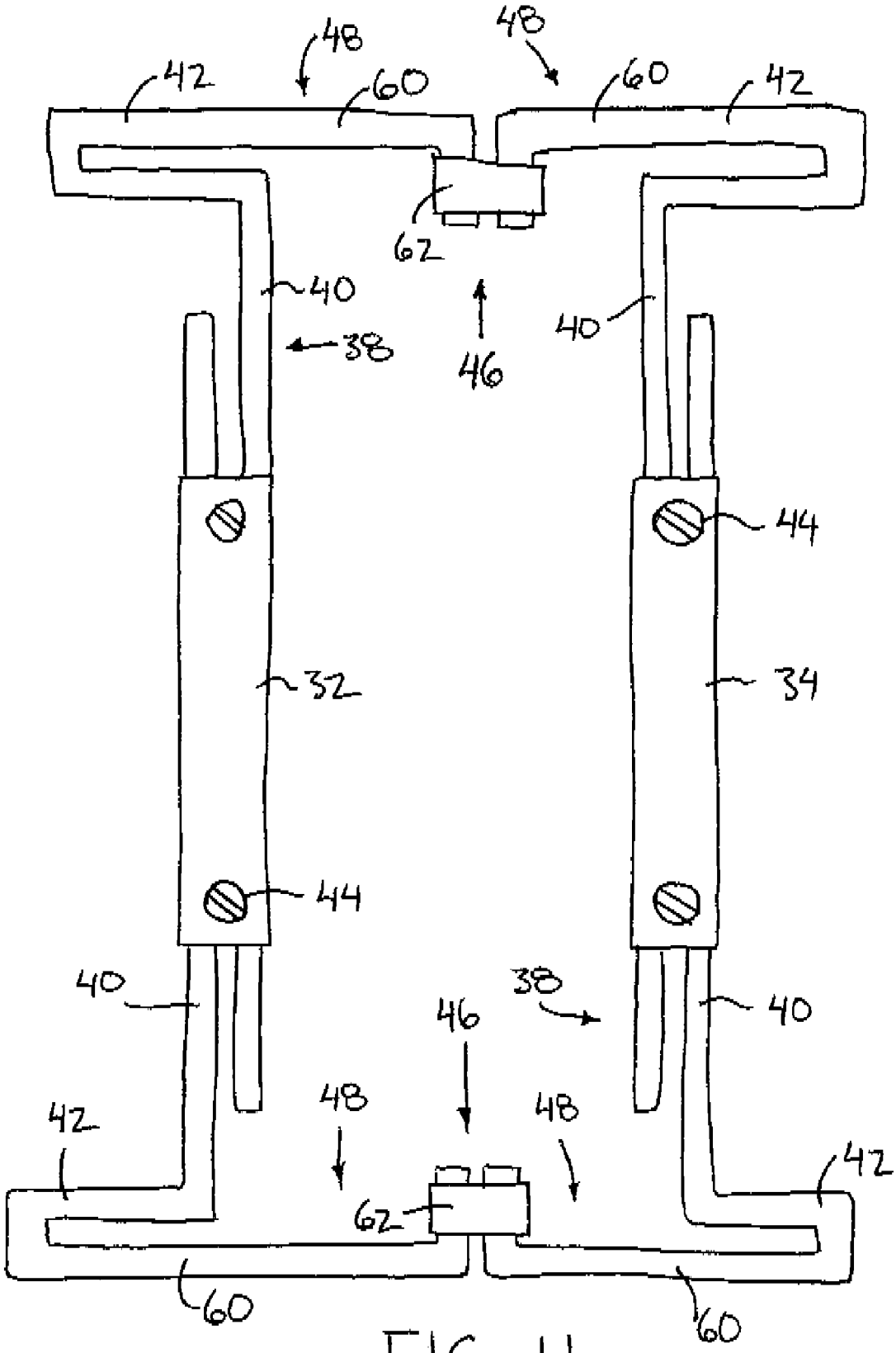
FIG. 11 is a top plan view of a further embodiment of the extensions of the base member.
Figure 12:
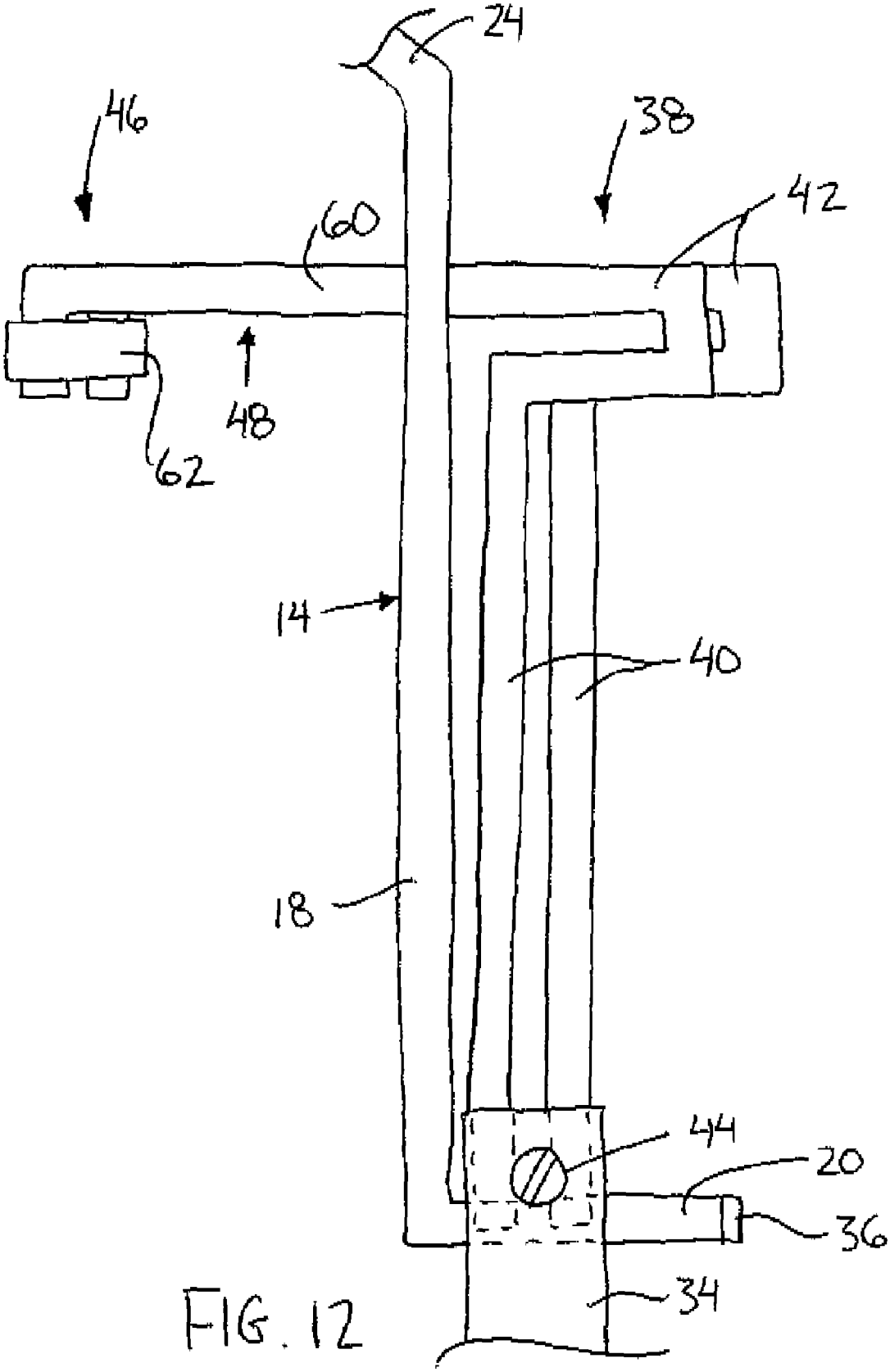
FIG. 12 is a top plan view of the extensions according to FIG. 11 in a collapsed and folded condition.

Turning now to FIGS. 11 and 12 a further embodiment of the extensions 38 is illustrated in which the extensions 38 are formed integrally with the crossbars 46 and spacing between the two crossbars 46 is adjusted by slidably displacing the main portion 40 of the extensions within the respective base members. The main portion of each extension in this instance comprises a single rod which is continuous with the U-shaped anchor portion 42 which again lies in a common plane with the longitudinal direction of the base member to extend laterally outwardly. In addition, an inward portion 60 of the extension 38 defines one of the sections 48 of the crossbar.

Each of the inward portions terminates at a pivot shaft 62 lying parallel to the pivot shaft of the opposing inward portion 60 of an extension on the opposite base member so that the link 56 similarly couples the two pivot shafts about respective parallel and spaced apart pivot axes about which the two sections 48 of the integral crossbars 46 are pivotal relative to one another. By providing a main portion comprising a single rod, the main portions of the two extensions at opposite ends of each base member can be overlapped in the longitudinal direction for further compacting and collapsing the shelter in storage. As shown in FIG. 12, the link 56 includes a spacing between the pivot shafts which is approximately equal to the width of the base member so that in storage the main portion of two different extensions of opposite base members can be folded adjacent one another for slidably being received with a common base member for storage. Screw clamps 44 similarly clamp the extensions in place.

Figure 13:
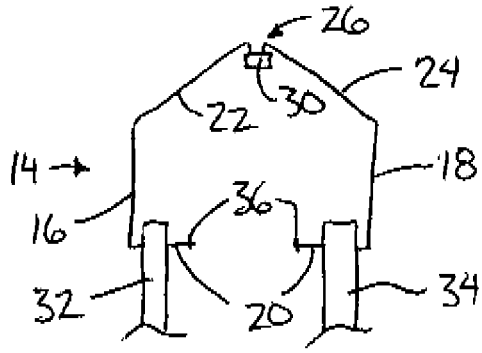
FIG. 13 is an elevational view of a further embodiment of the support arches.

Turning now to FIG. 13 a further embodiment of the pivot shafts is illustrated in which each of the pivot shafts 20 extends inwardly from the respective end portion 16 or 18 so at to be perpendicular thereto while still lying in a common plane with the respective arched segment 22 or 24. The end portions are thus positioned at an outer side of the respective base members rather than on an inner side as in the first embodiment. The pivot shafts 20 thus project from each end portion generally in the same radial direction away from the end portion as the respective arched segment.

Figure 14:
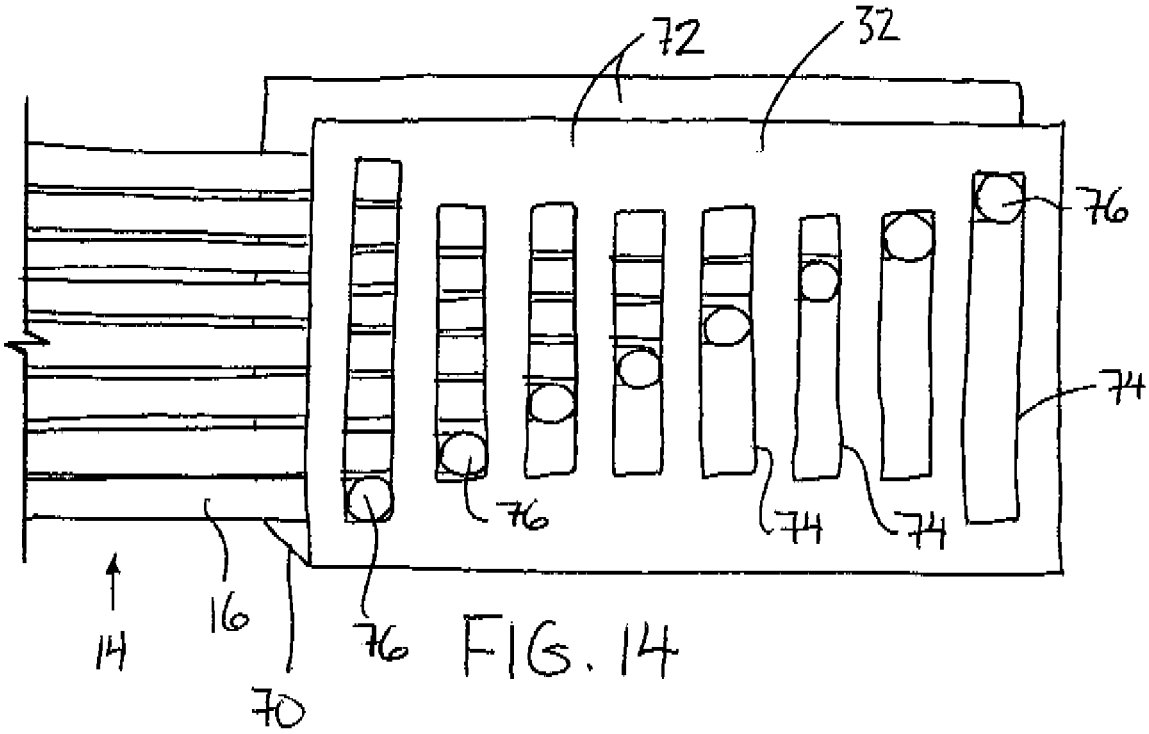
FIG. 14 is a perspective view of a further embodiment of one the base members.
Figure 15:
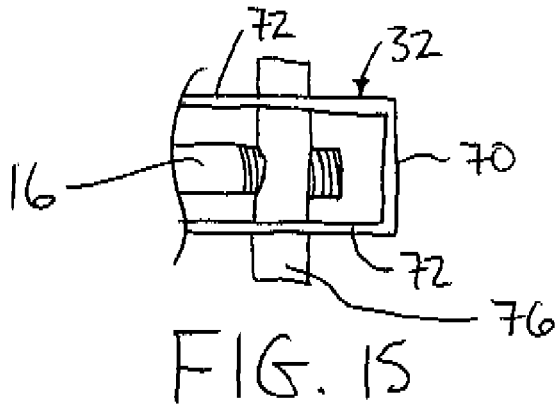
FIG. 15 is sectional view of the base member according to FIG. 14.

Turning now to FIG. 14 a further variation of the base member is illustrated in which each base member comprises a generally U-shaped channel having a bottom side 70 and parallel side walls 72 extending upwardly therefrom at spaced apart positions. Elongate openings are formed in the side walls 72 in pairs, each pair defining an elongate slot 74 spaced in a longitudinal direction of the base member from adjacent slots with all of the slots being parallel to one another. Each slot slidably supports a pivot shaft 76 of an end portion of a respective support arch therein. The end portions on the pivot shafts in this arrangement are each pivotal about a respective pivot axis of the pivot shaft 76 while being slidable in a radial direction of the pivot axis within the respective slot 74 which is radially oriented in relation to the pivot shaft. The height of each slot 74 is approximately equal to the combined stacked height of the end portions when stacked one against the other. Thus when positioning the arches to lay in the longitudinal direction of the spacing of the slots, a first outermost arch is positioned at its lowermost position of the pivot shaft within the respective slot with each successive pivot shaft being stacked higher within its respective slot until the opposite outermost stacked arch positions its pivot shaft 76 at the uppermost end of the slot 74. Each pivot shaft 76 abuts the end portion received between the side walls of the respective base member in a T-shaped configuration to threadably receive the end portion centrally on the pivot shaft 76.

Figure 16:
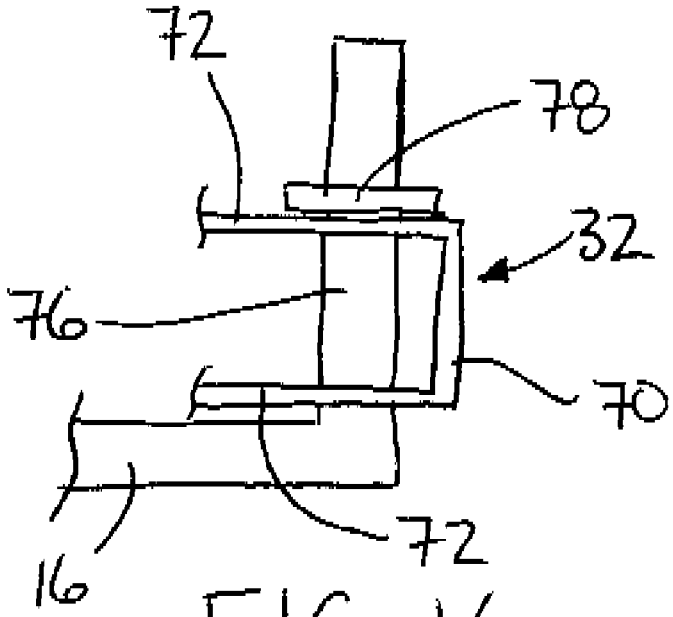
FIG. 16 and FIG. 17 are sectional views of alternative pivot shaft connections with the base according to FIG. 14.
Figure 17:
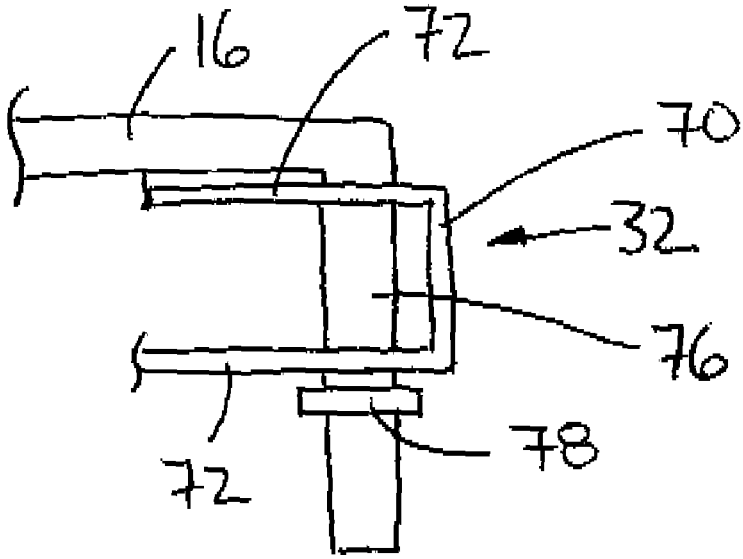

In alternative configurations, the end portions may be positioned adjacent the outer or the inner one of the side walls 72 forming the base member. In this instance each pivot shaft 76 is formed in an L-shaped configuration with the respective end portion as shown in FIGS. 16 and 17. A suitable retainer 78 is mounted on the pivot shaft at the opposite side wall from the end portion to retain the pivot shaft in an axial direction with respect to the respective slot 74 while permitting the pivot shaft 76 to remain slidable within the respective slot 74.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A portable shelter comprising:

a plurality of support arches, each arch comprising first and second end portions and first and second arched segments continuous with the first and second end portions respectively;

the first and second arched segments of each support arch being pivotally coupled to one another at an apex of the arch such that the end portions of each support arch are foldable against one another;

a first base member pivotally coupling each first end portion thereon such that the first end portion is be arranged for pivotal movement about a respective pivot axis such that:

each first end portion is offset in a radial direction in relation to the respective pivot axis from the first end portions of the other support arches; and each first end portion is offset in an axial direction in relation to the respective pivot axis from the first end portions of the other support arches;

a second base member pivotally coupling each second end portion thereon so as to be arranged for pivotal movement about a respective pivot axis such that:

each second end portion is offset in a radial direction in relation to the respective pivot axis from the second end portions of the other support arches; and each second end portion is offset in an axial direction in relation to the respective pivot axis from the second end portions of the other support arches;

the support arches being pivotal between a first position in which all of the support arches lay flat in a common plane so as to be nested within one another and a second position in which the end portions of each support arch are unfolded and spaced apart from one another and the support arches are angularly offset from one another about the respective pivot axes thereof to form a domed structure; and a cover of flexible material arranged to span the support arches in the second position such that the domed structure is arranged to be enclosed by the cover.

2. The shelter according to claim 1 wherein the support arches are identical in size.

3. The shelter according to claim 1 wherein each of the first end portions is pivotal within a plane which is parallel and spaced from the plane of the other first end portions and each second end portion is pivotal within a plane which is parallel and spaced from the plane of the second end portions.

4. The shelter according to claim 1 wherein the apex of each arch comprises a link pivotally coupled to the first arched segment at a first pivot axis and pivotally coupled to the second arched segment at a second pivot axis parallel and spaced from the first pivot axis.

5. The shelter according to claim 4 wherein each arched segment includes a pivot shaft received within the respective link at the apex which defines the pivot axis and which is oriented parallel to the respective end portion, the length of the pivot shaft being equal or less than radial spacing between adjacent end portions on the base members.

6. The shelter according to claim 1 wherein the pivot axes of the first and second base members are spaced apart in respective longitudinal directions of the base members and wherein each base member includes extension members extending longitudinally outward from opposing ends thereof.

7. The shelter according to claim 6 wherein the extension members are telescopic with respect to the respective base members.

8. The shelter according to claim 7 wherein there are provided clamping members on the base member to selectively restrict relative sliding movement of the extension members.

9. The shelter according to claim 6 wherein there is provided a pair of crossbars extending between the extension members of the opposed base members at opposite ends of the base members.

10. The shelter according to claim 9 wherein a longitudinal position of the crossbars in relation to the respective extension members is adjustable.

11. The shelter according to claim 9 wherein the crossbars are hinged centrally between the respective extension members the crossbar spans for folding of the crossbar.

12. The shelter according to claim 6 wherein there is provided an anchor portion at a free end of each extension member which is oriented transversely to the longitudinal direction of the extension members.

13. The shelter according to claim 12 wherein the anchors comprise lateral projections which project laterally outward away from the arches and the opposing base member.

14. The shelter according to claim 6 wherein each extension member is pivotally coupled to the corresponding extension member of the opposing base member.

15. The shelter according to claim 9 wherein the cover is suitably sized for covering a personal vehicle in which the crossbars are spaced apart from one another in the longitudinal direction of the base members corresponding to a wheel base of the vehicle.

16. The shelter according to claim 1 wherein the end portions of the support arches are slidable in the axial direction of the respective pivot axes in relation to the respective base member.

17. A portable shelter comprising:

a plurality of support arches, each arch comprising first and second end portions and first and second arched segments continuous with the first and second end portions respectively;

the first and second arched segments of each support arch being pivotally coupled to one another at an apex of the arch such that the end portions of each support arch are foldable against one another;

a first base member pivotally coupling each first end portion thereon so as to be arranged for pivotal movement about a respective pivot axis such that:

each first end portion is offset in a radial direction in relation to the respective pivot axis from the first end portions of the other support arches; and each first end portion is offset in an axial direction in relation to the respective pivot axis from the first end portions of the other support arches;

a second base member pivotally coupling each second end portion thereon such that the second end portion is so arranged for pivotal movement about a respective pivot axis such that:

each second end portion is offset in a radial direction in relation to the respective pivot axis from the second end portions of the other support arches; and each second end portion is offset in an axial direction in relation to the respective pivot axis from the second end portions of the other support arches;

each of the end portions being pivotal within a respective pivot plane which is oriented perpendicularly to the respective pivot axis;

the pivot plane of each end portion being parallel and spaced apart from the pivot plane of the other end portions;

the support arches being pivotal between a first position in which all of the support arches lay flat in a common plane so as to be nested within one another and a second position in which the end portions of each support arch are unfolded and spaced apart from one another and the support arches are angularly offset from one another about the respective pivot axes thereof to form a domed structure; and a cover of flexible material arranged to span the support arches in the second position such that the domed structure is arranged to be enclosed by the cover.

18. The shelter according to claim 17 wherein the support arches are identical in configuration to one another.

19. A portable shelter comprising:

a plurality of support arches, each arch comprising first and second end portions and first and second arched segments continuous with the first and second end portions respectively;

the first and second arched segments of each support arch being pivotally coupled to one another at an apex of the arch such that the end portions of each support arch are foldable against one another;

a first base member pivotally coupling each first end portion thereon so such that the second end portion is as to be arranged for pivotal movement about a respective pivot axis such that:

each first end portion is offset in a radial direction in relation to the respective pivot axis from the first end portions of the other support arches; and each first end portion is slidable in an axial direction of the respective pivot axis such that the first end portion is arranged to be offset in the axial direction in relation to the respective pivot axis from the first end portions of the other support arches;

a second base member pivotally coupling each second end portion thereon so such that the second end portion is as to be arranged for pivotal movement about a respective pivot axis such that:

each second end portion is offset in a radial direction in relation to the respective pivot axis from the second end portions of the other support arches; and each second end portion is slidable in an axial direction of the respective pivot axis such that the second end portion is arranged to be offset in the axial direction in relation to the respective pivot axis from the second end portions of the other support arches;

each of the end portions being pivotal within a respective pivot plane which is oriented perpendicularly to the respective pivot axis;

the pivot plane of each end portion being parallel and spaced apart from the pivot plane of the other end portions;

the support arches being pivotal between a first position in which all of the support arches lay flat in a common plane so as to be nested within one another and a second position in which the end portions of each support arch are unfolded and spaced apart from one another and the support arches are angularly offset from one another about the respective pivot axes thereof to form a domed structure; and a cover of flexible material arranged to span the support arches in the second position such that the domed structure is arranged to be enclosed by the cover.

* * * * *